US006116880A

United States Patent [19]

Bogue et al.

[11] Patent Number: 6,116,880

[45] Date of Patent: Sep. 12, 2000

[54] APPARATUS FOR MELT SPINNING FEEDSTOCK MATERIAL

[75] Inventors: Beuford A. Bogue, Broad Run; Mesfin B. Abdi; Claude Bayard, both of Arlington, all of Va.; Robert A. Madsen, Washington, D.C.; James H. Perkins, Cross Junction, Va.

[73] Assignee: Fuisz Technologies Ltd., Chantilly, Va.

[21] Appl. No.: 09/113,707

[22] Filed: Jul. 10, 1998

[51] Int. Cl.[7] ..... A23G 7/00

[52] U.S. Cl. ..... 425/8; 425/9

[58] Field of Search ..... 425/8, 9

[56] References Cited

U.S. PATENT DOCUMENTS

| | | | |
|---|---|---|---|
| 3,070,045 | 12/1962 | Bowe | 107/8 |
| 3,073,262 | 1/1963 | Bowe | 107/8 |
| 3,930,043 | 12/1975 | Warning et al. | 426/515 |
| 4,288,397 | 9/1981 | Snowden et al. | 425/8 |
| 4,855,326 | 8/1989 | Fuisz | 514/777 |
| 5,011,532 | 4/1991 | Fuisz | 106/215 |
| 5,236,734 | 8/1993 | Fuisz | 426/641 |
| 5,238,696 | 8/1993 | Fuisz | 426/565 |
| 5,427,811 | 6/1995 | Fuisz et al. | 426/465 |
| 5,445,769 | 8/1995 | Rutkowski et al. | 264/8 |
| 5,447,423 | 9/1995 | Fuisz et al. | 425/9 |
| 5,458,823 | 10/1995 | Perkins et al. | 264/8 |
| 5,683,720 | 11/1997 | Myers et al. | 424/489 |
| 5,743,157 | 4/1998 | Hinze | 65/516 |
| 5,834,033 | 11/1998 | Abdi et al. | 425/8 |
| 5,851,454 | 12/1998 | Rutkowski et al. | 425/8 |

*Primary Examiner*—Robert Davis
*Attorney, Agent, or Firm*—John F. Levis

[57] ABSTRACT

A spinner head provides for the production of melt-spun product. The spinner head includes a base and a cover spaced from the base. A plurality of discrete spaced apart elongate heating elements are positioned between the base and the cover and define a chamber for accommodating feedstock material therein. An elongate generally annular housing having plural circumferentially spaced cylindrical passages extending therethrough is positionable over the heating elements. The housing defines a plurality of circumferentially spaced fins projecting radially inward. Each of the fins have tapered sidewalls which generally converge as the fin extends radially inward. The sidewalls of adjacent fins cooperate to define longitudinal radially-directed slots between the cylindrical passages so as to permit passage of the feedstock material therethrough.

24 Claims, 8 Drawing Sheets

PRIOR ART

APPARATUS FOR MELT SPINNING FEEDSTOCK MATERIAL

FIELD OF THE INVENTION

The present invention relates generally to an apparatus for heating and spinning feedstock materials. More particularly, the present invention relates to an improved spinner head device which efficiently processes the feedstock material and reduces the formation of clogs in the flow path.

BACKGROUND OF THE INVENTION

Various machines have been devised for the melting and spinning of meltable materials, especially sugar. The meltable material is introduced into a spinning head of a spinning machine in solid form. The material is melted therein just prior to be spun out from the spinner head where it solidifies in the air. The process of melt spinning sugar is most commonly seen in the manufacture of floss-like cotton candy.

Numerous machines have been specifically designed for melt spinning cotton candy. Examples of such machines are shown in U.S. Pat. Nos. 3,930,043, 3,073,262 and 3,070,045. These cotton candy forming spinning machines generally include a spinner head having a cylindrical apertured wall. Sugar in solid form is introduced into the spinner head where it is melted. The spinning of the spinner head causes the melted sugar to be spun out through the apertures in the cylindrical wall where it solidifies into the floss-like structure referred to as cotton candy. The characteristic shape and consistency of the spun material are influenced by many factors. These factors include size and construction of the spinner head, size, arrangement and location of the apertures in the cylindrical wall, as well as the manner in which heat is applied to the spinner head.

While typical cotton candy machines serve adequately in converting granular sugar into floss-like cotton candy, these cotton candy spinner heads do not produce material with repeatable consistency and therefore their use is not entirely satisfactory for spinning other materials, or other materials in combination with sugar. The art has seen a need for commercial spinner heads which produce repeatedly reliable material consistency so that the melt spinning of sugar as well as other materials, sugar combined with other materials as well as non-saccharide materials both for use in foodstuffs and pharmaceuticals, may be reliably achieved. U.S. Pat. No. 4,855,326 describes a melt-spin process for production of materials having pharmacological properties. U.S. Pat. No. 5,011,532 concerns the melt-spin production of oleaginous substances.

The art has also seen other advances in the spinner head construction for the production of various materials. For instance, U.S. Pat. No. 5,427,811 discloses a method and apparatus for spinning thermal-flow materials. The apparatus described therein includes a rotatable spinner head having a helical heating cable defining an annular processing wall having spaces between the heating cable through which material is propelled as the spinner head is rotated. The apparatus described in the '811 patent subjects the material to thermal-flow melt spin processing referred to as "Flash flow". Other commonly assigned patents describing the Flash flow process include U.S. Pat. No. 5,447,423, U.S. Pat. No. 5,445,769, U.S. Pat. No. 5,236,734 and U.S. Pat. No. 5,238,696.

Another technique for processing material in a melt spin environment is to subject the material to "Liquiflash" processing where reduction of the feedstock material occurs under conditions of heat and pressure so that any resistance of the material to liquid flow, i.e., viscosity which impedes the propensity to form liquid droplets, is eliminated. A method of forming liquiflash material is described in commonly assigned pending U.S. patent application Ser. No. 08/330,412 filed Oct. 28, 1994, now U.S. Pat. No. 5,683,720.

The Liquiflash and Flash-flow processes may be employed with various feedstock materials, specifically various foodstuffs including saccharides and non-saccharides as well as pharmaceuticals and combinations thereof. One apparatus which has been developed which is particularly suitable for spinning various foodstuffs and pharmaceuticals is shown and described in commonly assigned U.S. Pat. No. 5,458,823 issued Oct. 17, 1995. This patent discloses a spinner head having a plurality of discrete, closely spaced elongate heating elements disposed between a base and a cover. Feedstock material which is introduced into the spinner head may be expelled through the spaces formed between the heating elements.

In order to more efficiently produce pharmaceutical products, the spinner head of the '823 patent discloses an annular housing assembly formed of heat conductive material which is positioned over the heating elements. The heating elements are therefore isolated from the feedstock material by the annular housing assembly. In order to permit expulsion of feedstock material form the spinner head, the wall of the annular housing includes a plurality of slot-like openings through which the material may be expelled. The spinner head of the '823 patent is especially useful in the manufacture of pharmaceutical material in that in order to prevent contamination of reformed product, the annular housing may be easily removed from the heating elements so as to permit thorough cleaning.

Spinner heads of the type currently available in the art, however, typically experience a condition known as "blow by" in which unmelted, and therefore, unprocessed feedstock is ejected through the openings in the processing wall. Blow by is undesirable since it reduces the overall efficiency of the spinner head, therefore, attempts have been made to minimize the levels of blow by. One way to control blow by is to reduce the size of the opening extending through the processing wall. However, if these openings are made too narrow, they may have a negative effect on the morphology of the melt spun material and the amount of material which can be processed therethrough. In addition, undersized openings are subject to clogging which increases the down time of the spinner head. An alternative blow by minimizing method has been to employ restriction rings which extend about the radial perimeter of the spinner head as described in U.S. Pat. No. 5,458,823. Restriction rings typically obstruct the path through which the material must flow thereby increasing the time in which the material is in contact with the heated processing wall. Accordingly, there is less chance for the feedstock to be expelled in an unprocessed state.

The use of restriction rings or the narrowing of the exit slots, however, present a new set of complications. Specifically, restriction rings tend to lead to the formation of stagnation points which create clogs and unwanted flow path obstructions. For example as shown in FIG. 1, spinner head assemblies especially those which fit over tubular heating coils have generally planar radial inner processing wall surfaces 2 against which the feedstock material 3 is forced. The radial inner surface of an outer restriction ring 4 is also typically a generally planar surface. The configuration of these surfaces results in material buildup which has a cone-like configuration forming stagnation points 5. The material buildup covers the inner surfaces of the processing wall, thereby reducing efficiency of the head. When the material buildups to a certain degree, the material can no longer pass through the processing wall. Accordingly, spinner heads of this type typically require a considerable amount of maintenance to keep them in working order.

In addition, spinner heads currently available are limited in the amount of material they can process due to the limited ability to transfer thermal energy to the feedstock material. The planar surfaces of the processing wall present a relatively small amount of heated surface per unit area of the processing wall. Therefore, the ability of the processing wall to transfer heat to the feedstock is limited. Furthermore, since the material must be heated to processing temperature quickly after hitting the planar surface, these designs do not effectively process temperature sensitive materials which require a more gradual heating process.

Accordingly, it would be desirable to provide a spinner head for producing melt spun material that reduces the amount of feedstock blow by while reducing the formation of clog forming stagnation points. It would be further desirable to provide a spinner head for producing melt spun material which has increased processing wall surface area to increase the processing output of the spinner head.

SUMMARY OF THE INVENTION

It is an advantage of the present invention to provide an improved apparatus for processing feedstock materials in a spinner head.

It is a further advantage of the present invention to provide a spinner head which reduces the amount of blow by and prevents the formation of clog forming stagnation points.

The present invention provides a spinner head which includes a base and a cover positionable over the base. A plurality of discrete elongate heating elements extend between the base and the cover in spaced side-by-side configuration. An elongate generally annular housing is provided and includes a plurality of circumferentially spaced cylindrical passages extending therethrough. The annular housing is positionable over the heating elements with the heating elements residing within the passages. The housing defines a plurality of circumferentially spaced fins projecting radially inward defining a processing wall for acting upon feedstock material. Each of said fins has tapered sidewalls which generally converge as the fin extends radially inward. The sidewalls of adjacent fins cooperate to define longitudinal radially-directed slots between said cylindrical passages so as to permit passage of the feedstock material therethrough. The cover and the annular housing define therein a chamber for accommodating and processing the feedstock material.

In the preferred embodiment the present invention further includes a flow restriction device including an annular member disposed exteriorly about the annular housing. The annular member includes an annular wall defining a plurality of circumferentially spaced openings extending radially therethrough. Each of the openings has a radial inner and outer end and the radially inner end of each opening substantially radially aligns with one of the plurality of slots to permit restricted passage of the expelled feedstock material therethrough. At least one of the openings in the annular wall extends at an angle from the corresponding slot such that the radially inner and outer ends are circumferentially offset.

As a result of the present invention, the spinner head is capable of efficiently processing feedstock material having temperature sensitive components without the need to frequently interrupt production in order to clean the spinner head.

DETAILED DESCRIPTION OF THE PREFERRED EMBODIMENTS

Figure 1:
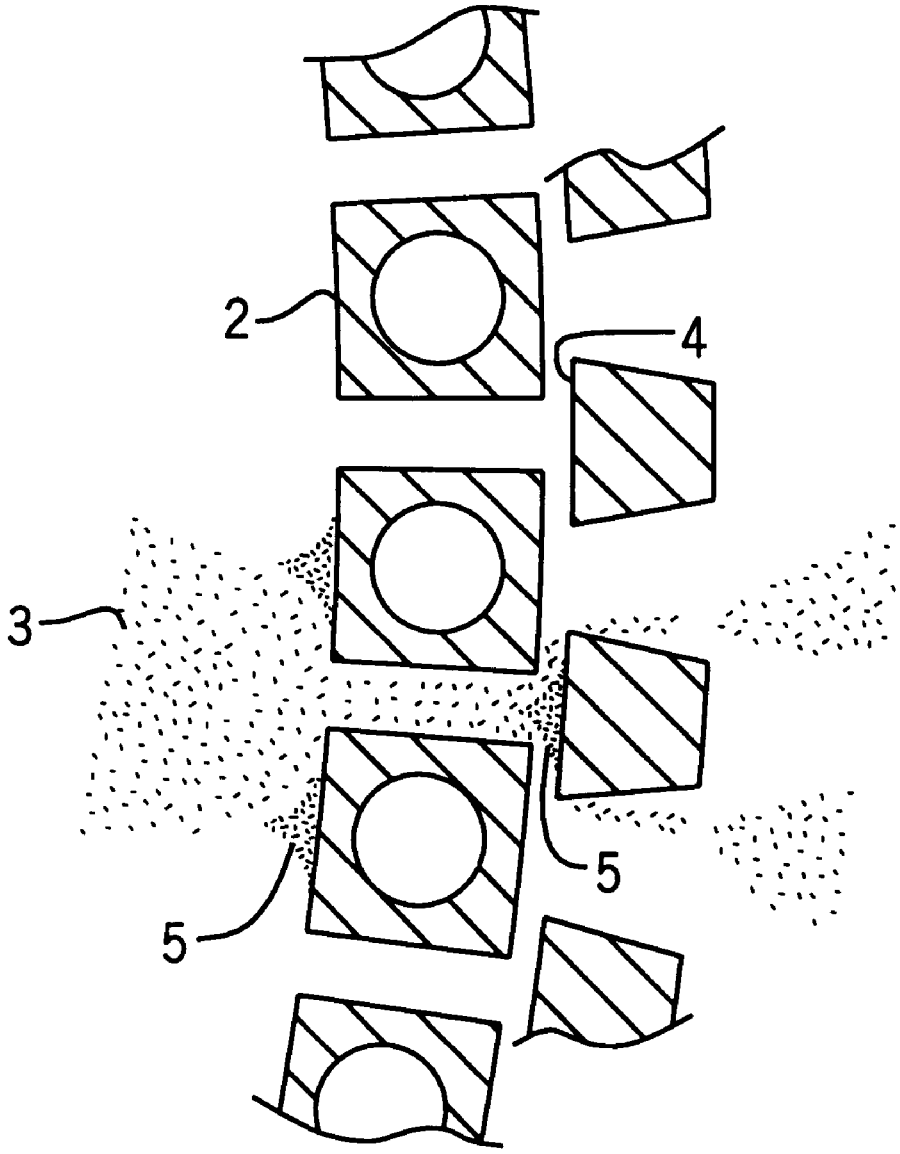
FIG. 1 is a partial cross-sectional view showing an annular housing of a current spinner head bounded by an exterior ring and the formation of stagnation points.

The present invention contemplates subjecting solid, non-solubilized feedstock material (feedstock) which is capable of undergoing intraparticle Flash flow processing or Liquiflash processing at a temperature sufficient to reduce the infrastructure of the feedstock material to physically cause the material to deform and pass through an opening under force. The force used in the present invention is centrifugal force provided by a spinner head from which the feedstock material is expelled at a high speed. Preferably, no external force is imposed upon the feedstock material after it has been expelled from the spinner head other than the resistance provided by ambient atmosphere. Feedstock materials so expelled, instantly reform as a solid having changed morphology as a result of the material being expelled from the spinner head.

The present invention may employ Liquiflash processing technology. Liquiflash processing contemplates the reduction of the feedstock material under conditions of heat and pressure to a condition wherein any assistance to liquid flow, e.g., viscosity which impedes the propensity to form liquid droplets, is eliminated. On a macro scale, this condition appears to provide a liquid or liqui-form which terms are used interchangeably herein. With Liquiflash processing once the feedstock is reduced to a condition where substantially all resistance to liquid flow is removed, shear forces are imparted to the flowing feedstock in amounts sufficient to separate individual or discrete particles from the mass. The particles produced by this separation process have size and shape influenced only by the natural mass separation of the flowing feedstock in the presence of impinging shear force.

More particularly, the present invention may be employed in combination with Flash flow processing technology. Flash flow is referred to as a phenomena which occurs when solid material is subject to conditions of temperature and shear sufficient to provide internal flow of the material at a subparticle level. The solid material undergoes thermo-flow, that is, material undergoes intraparticle flow when heated prior to undergoing substantial degradation or decomposition. As used in the present invention, the flash flow phenomena is effected when the material is exposed to heat for a short amount of time, not more than one second and preferably on the order of tenths of a second. The phenomena can be produced by relatively high speed distribution of the thermo-flow material to the environment of elevated temperature under constant force such as centrifugal force caused by the high speed rotation of the spinner head.

As indicated above, the morphology of the reformed product is influenced by, among other factors, the size and shape of the openings through which the reformed product exits the spinner head. By controlling the amount of heat applied to the spinner head as well as the opening through which the thermo-flow product is expelled, the present invention provides the ability to control the morphology of the material expelled from the spinner head.

Figure 2:
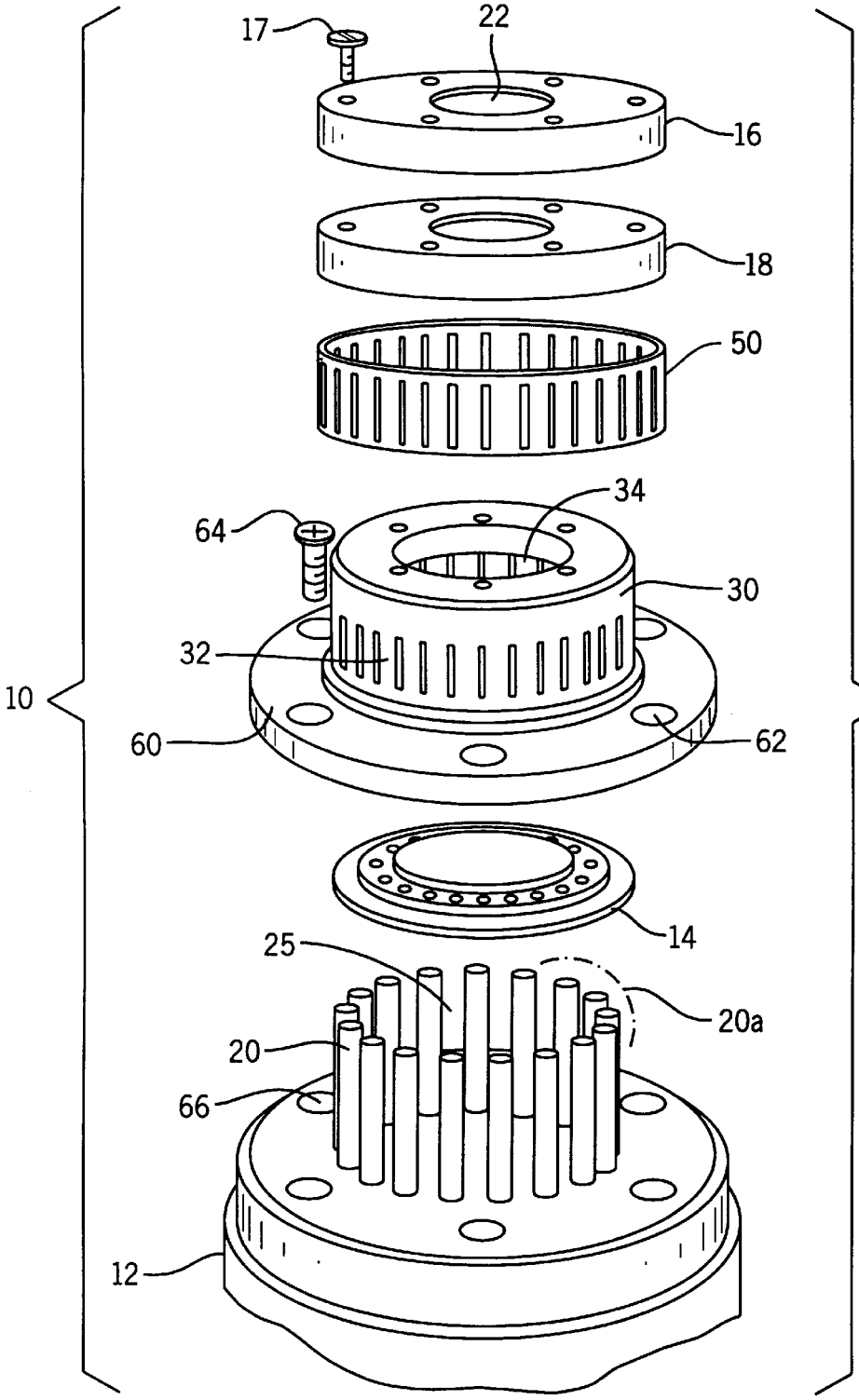
FIG. 2 is an exploded perspective view of the spinner head of the present invention.

Referring now to FIG. 2 of the drawings, a spinner head 10 used in accordance with the present invention is shown. Spinner head 10 is generally employed in the manner similar to a conventional cotton-candy spinning machine used to expel feedstock which has been processed within the spinner head into a collection basin or bin (not shown). Use of collection bins in combination with conventional spinner heads to form floss-like cotton candy from sugar is well known in the art.

Spinner head 10 includes a generally cylindrical base 12 including a planar bottom and a heat insulating support 14 to insulate base 12 from the heated processing wall. Spaced above base 12 is a generally cylindrical cover 16 including a top heat insulating support 18. Appropriate mechanical structures such as bolts 17 may be employed to support cover 16 in spaced relationship over base 12. Base 12 and cover 16 may be formed from stainless steel or other suitable material.

Figure 3:
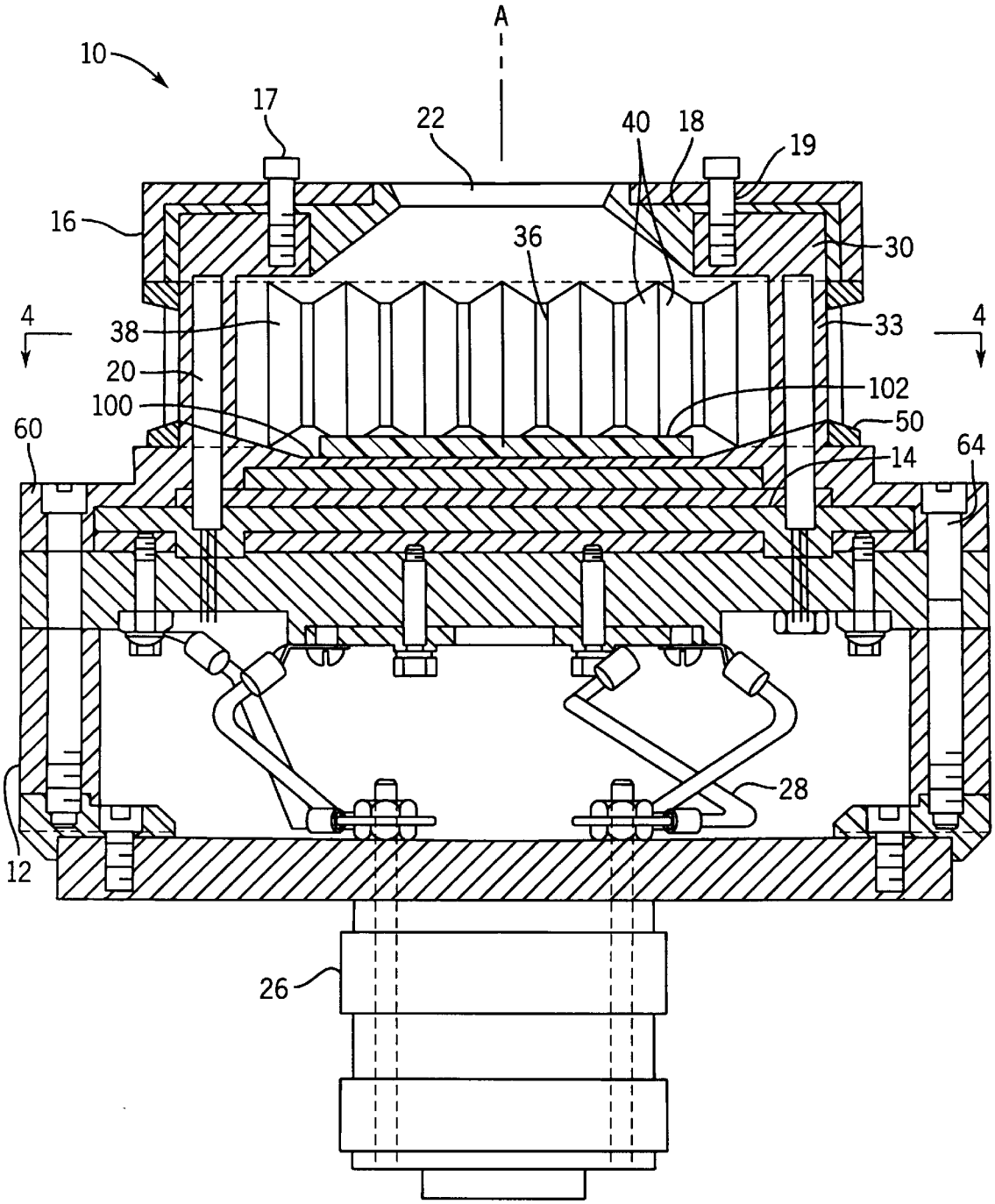
FIG. 3 is a partial cross-sectional view of the spinner head of FIG. 2.

Referring additionally to FIG. 3, extending between base 12 and cover 16 are a plurality of individual tubular heating elements 20 which are arranged in a generally circular array 20*a* about a central axis of a rotation A. Base 12, cover 16 and the tubular heating elements 20 define a chamber 25 for accommodating therein feedstock material. The individual tubular heating elements 20 provide the heat necessary to effect a physical transformation of the feedstock material contained in chamber 25. In order to insert the feedstock into the chamber 25 of spinner head 10, cover 16 includes a generally centrally located opening 22. A stem 26 extends centrally downwardly from base 12 and includes an appropriate mechanism (not shown) providing for the rotation of spinner head about axis A in a manner which is well known in the spinner head art. Base 12 also houses an electrical interface assembly 28 (FIG. 3) which powers tubular heating elements 20. Interface assembly 28 preferably permits the heating elements to be independently controlled.

The ability of spinner head 10 to accommodate feedstock material within chamber 25 and to provide the appropriate application of heat and pressure to expel reformed product from the spaces 24 between tubular heating elements 20, is shown and described in further detail in commonly assigned U.S. Pat. No. 5,458,823.

Figure 4:
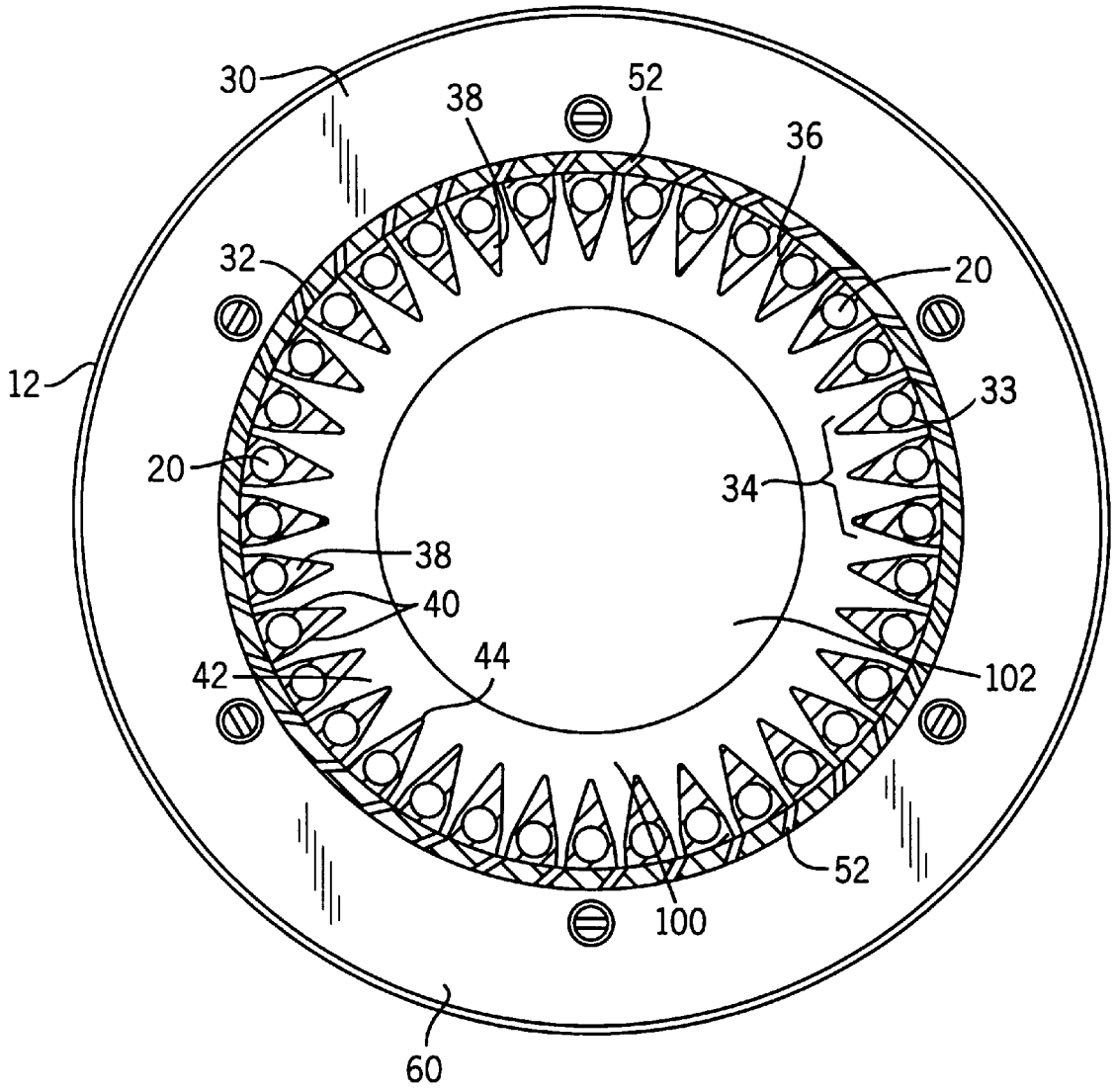
FIG. 4 is a cross-sectional view taken along line 3—3 of FIG. 3.
Figure 5:
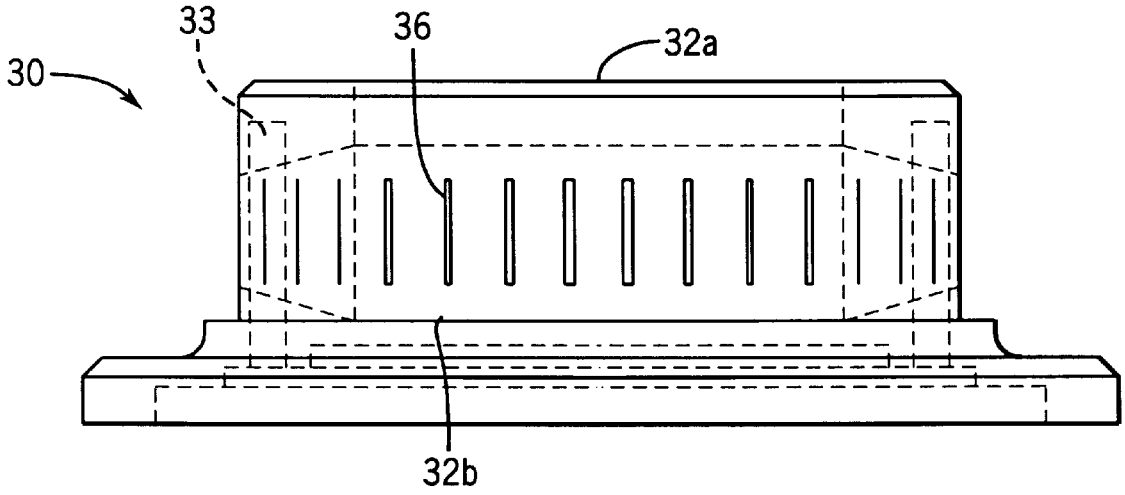
FIG. 5 is a side elevational view of the annular housing of FIG. 2.

With additional reference to FIGS. 3–5, the present invention in its preferred embodiment provides for the use of an annular housing 30. Annular housing 30 includes an upstanding annular sidewall 32 having a plurality of longitudinal cylindrical passages 33 extending axially in sidewall 32. The size and location of the cylindrical passage are arranged in annular processing wall 32 to correspond to the size and locations of the tubular heating elements 20. Annular housing 30 is designed to fit over the array of tubular heating elements 20*a* with each individual tubular heating element 20 being resident within one of the passages within annular housing 30. Chamber 25 which accommodates feedstock material is now further defined by the inner surface 34 of annular housing 30. In order to permit expulsion of feedstock material from spinner head 10, annular sidewall 32 of annular housing 30 includes a plurality of longitudinal radially directed slots 36 extending therethrough. Slots 36 extend through sidewall 32 between upper wall 32*a* and lower wall 32*b*. Slots 36 are in communication with chamber 25 within spinner head 10 and with the exterior of spinner head 10 to permit expulsion of feedstock material therethrough. Sidewall 32 heated by heating elements 20, forms the processing wall which elevates the temperature of the feedstock material to permit the material to undergo intrapartical flow.

Figure 6A:
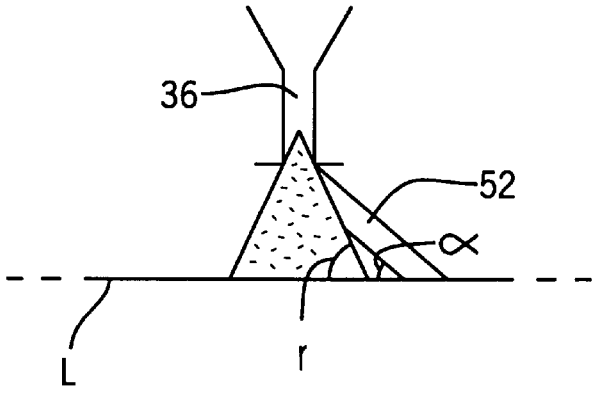
FIG. 6A is a schematic depicting the angle of repose relative to the angle of the slits extending through the restriction ring.
Figure 6:
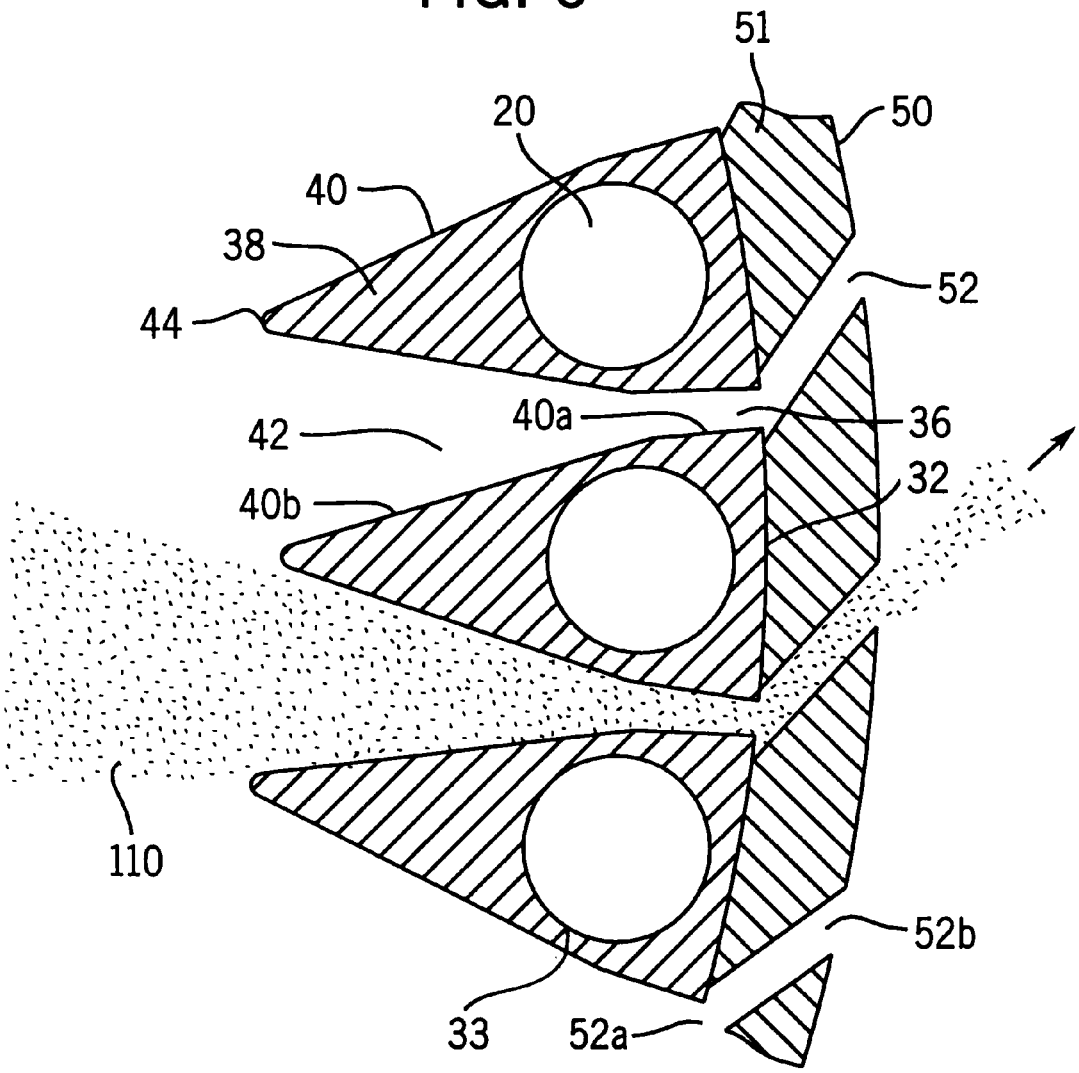
FIG. 6 is a partial cross-sectional view of the annular housing of FIG. 1 and a restriction ring showing the flow of feedstock material therethrough.

Referring also to FIG. 6, annular processing wall 32 and slots 36 formed therethrough are specially configured in order to provide the advantages of the present invention. As shown in FIGS. 4 and 6, the inner wall 34 is formed of series of fins 38 having a cone-like shape in cross-section. Each fin includes sidewalls 40 which generally converge as they extend radially inward. Sidewalls 40 are formed of a first and second angled segments 40*a* and 40*b*. First segment 40*a* extends from the outer surface of annular wall 32 to approximately the midline of passage 33. First segment 40*a* has a slight incline and tapers rather gradually. Second segment 40*b* extends from first segment 40*a*, at a greater degree of incline than segment 40*a*, toward the radially inner most portion of annular wall 32 where it joins with the sidewall 40 forming the opposite side of fin 38 at essentially a point 44. Due to the configuration of the fin sidewalls 40, the distance between sidewalls 40 of adjacently disposed fins varies over the radial extend of adjacently disposed fins 38. Opposed sidewalls 40 of adjacent fins 38 form a tapered channel 42 which assists in directing the flow of feedstock material 110 through the slots 36 in annular wall 32. When annular housing 30 is positioned over heating elements 20, the heating elements extend through each of the fins. Fins 38 are preferably integrally formed with annular housing 30 with the shape of fins 38 being formed through a machining process. However, it is within the contemplation of the present invention that each fin is separately formed and combinable with each other to form annular housing 30.

Fins 3 provide at least two significant advantages over what has been provided in the art. First, by essentially tapering to a point 44, fins 38 do not present a planar or tangential surface upon which the feed stock may build up and form stagnation points. In addition, fin sidewalls 40 are relatively shear with respect to the flowing feedstock 1 10, such that they permit the feedstock to flow by without creating a surface upon which feedstock can accumulate. Therefore, the annular housing resists clogging, thereby reducing the need for constant maintenance and cleaning. Second, fins 38 present a significant increase in processing wall service area. Therefore, a large portion of the feedstock material in chamber 25 is exposed to the heated processing wall resulting in the heat being more evenly distributed to the feedstock. This reduces the likelihood of burning the feedstock. In addition, by increasing the processing wall service area, more thermal energy can be transferred to the feedstock thereby permitting increases in product output.

Furthermore, due to the tapered fins ability to even distribute thermal energy, fins 38 are especially useful when processing feedstock which is particularly sensitive to moderately high temperature, such as those containing Ibuprofen R.A.

While the annular housing 30 of the present invention efficiently processes the feed stock material, a certain amount of unprocessed material, known as "blow by" is expelled from spinner head 10. In order to reduce the amount of blow by and in some cases further effect the morphology of the spun product, spinner head 10 further includes an annular restriction ring 50. Restriction ring 50 which is shown in further detail in FIG. 6 is a generally annular member formed of heat conductive material such as stainless steel, and which is designed to fit in exterior circumscribing relationship about annular housing 30. Due to its heat conducting properties, restriction ring 50 transfers thermal energy to the feed stock as it passes therethrough, thereby aiding in the processing of the feedstock. Restriction ring 50 includes a sidewall 51 which is generally an apertured member having a series of angled elongate slits 52 in spaced circumferential disposition thereabout. Restriction ring 50 is positioned over annular housing 30 in such a manner that the inner radial portion 52*a* of each of the slits 52 is directly radially aligned with one of the slots 36 of annular housing 30.

With additional reference to FIG. 6A, slits 52 are preferably formed at an angle $\alpha$ relative to a line L tangent to the restriction ring adjacent to a particular slit 52. Therefore, the radial inner portion 52A and outer end portion 52B of the slits 52 are circumferentially offset. The precise magnitude of the angle depends on the angle of repose r of the particular material as it is being processed. When granular material such as sugar is poured onto a planar surface, it tends to pile up forming a conical-like mound. The angle formed between the walls of the cone-like mound and the surface is known in the art as the angle of repose, r. The magnitude of this angle depends on the specific properties of the material including its mass, granularity and surface texture. It is the tendency of granular material to form such mounds that leads to the formation of stagnation points which leads to the clogging of spinner heads (FIG. 1). As shown schematically in FIG. 6A, in order to prevent the build up of material and the formation of stagnation points the angle of slits a should be less than the angle of repose r, i.e., the sidewalls forming slit 52 should be more gradually inclined then the sidewalls formed by the mound of material forming the stagnation point.

Accordingly, when restriction ring 50 is employed, as the melt spun product exits annular housing 30, the flow is redirected along an angled path restricting direct expulsion of such material from spinner head 10. The tortuous path presented by restriction ring 50 increases the time that the spun product is in contact with a heated surface, thereby yielding less expulsion of unprocessed material, blow by, and resisting the formation of clog forming stagnation points.

The present invention further increases the efficiency of spinner head 10 by eliminating any unnecessary obstruction which would prevent the expulsion of feedstock material. Spinner head assemblies have typically been secured to the base by tie rods or bolts which extend from the top cap of the spinner head to the base. These bolts tend to be positioned in the path of the material to be expelled thereby restricting the flow thereof. Certain materials such as emulsifiers or oil laden materials build up significantly causing "blinding" of those heaters adjacent to the tie bars leading to burning of the material. Tie rods also tend to make the spinner head more difficult to clean. Therefore, the bolts reduce the output efficiency of the head and lead to clogging of the device.

In order to overcome these limitations, annular housing 30 of the present invention includes an outer flange 60 extending radially outwardly from the bottom thereof as shown in FIGS. 2–4. Flange 60 includes a plurality of apertures 62 extending therethrough to provide fastening hardware 64 to pass therethrough. Base 12 includes threaded openings 66 to receive this hardware and permit annular housing 30 to be fixedly secured to base 12. The fastening hardware 64 in the present design, therefore, does not obstruct the flow of material from spinner head 10. The cover 16 and insulating support 18 as well as restriction ring 50 are held on by bolts 17 extending through cover 16 and insulating support 18 which threadedly engage apertures 19 formed in the upper portion of annular housing 30 as shown in FIG. 3.

Figure 7:
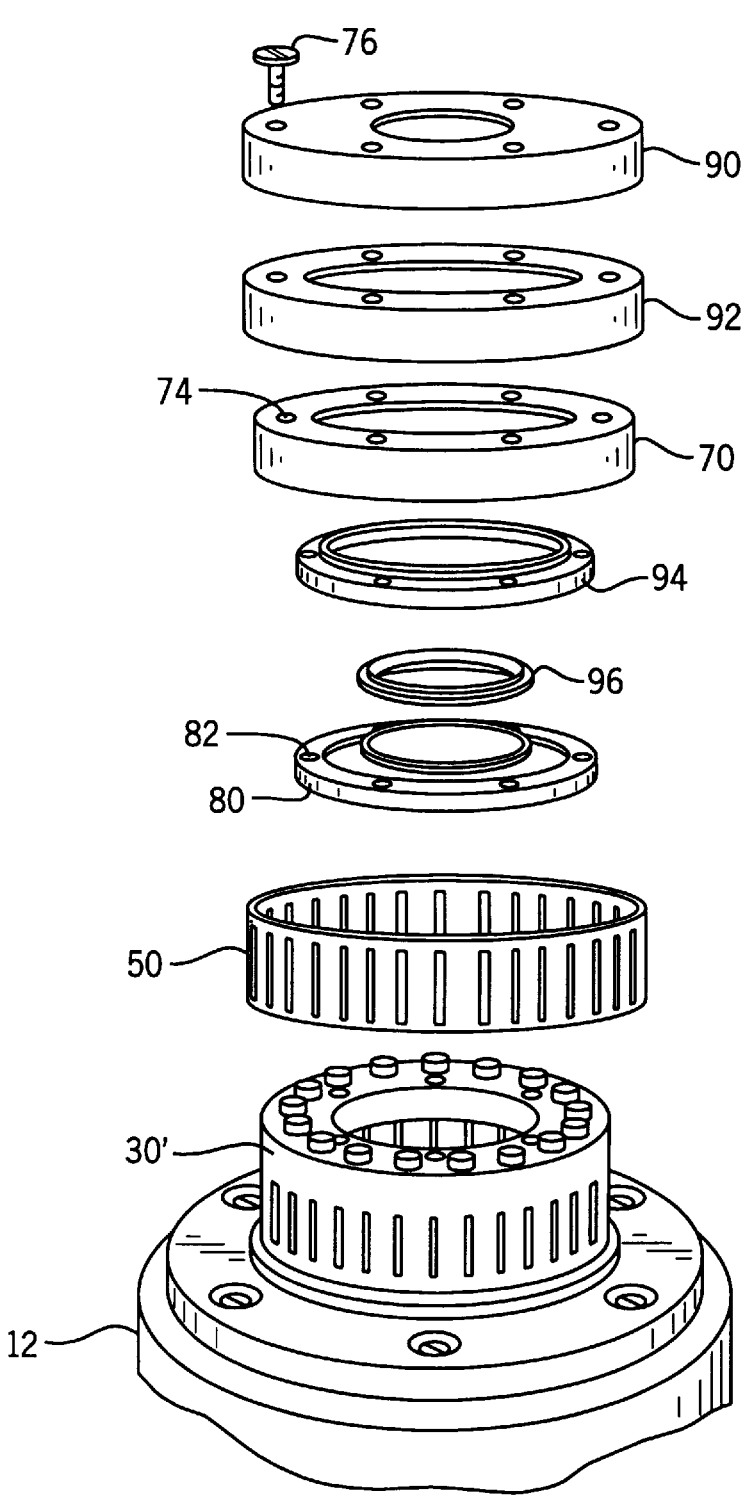
FIG. 7 is an exploded perspective view of an alternative embodiment of the spinner head of the present invention.
Figure 8:
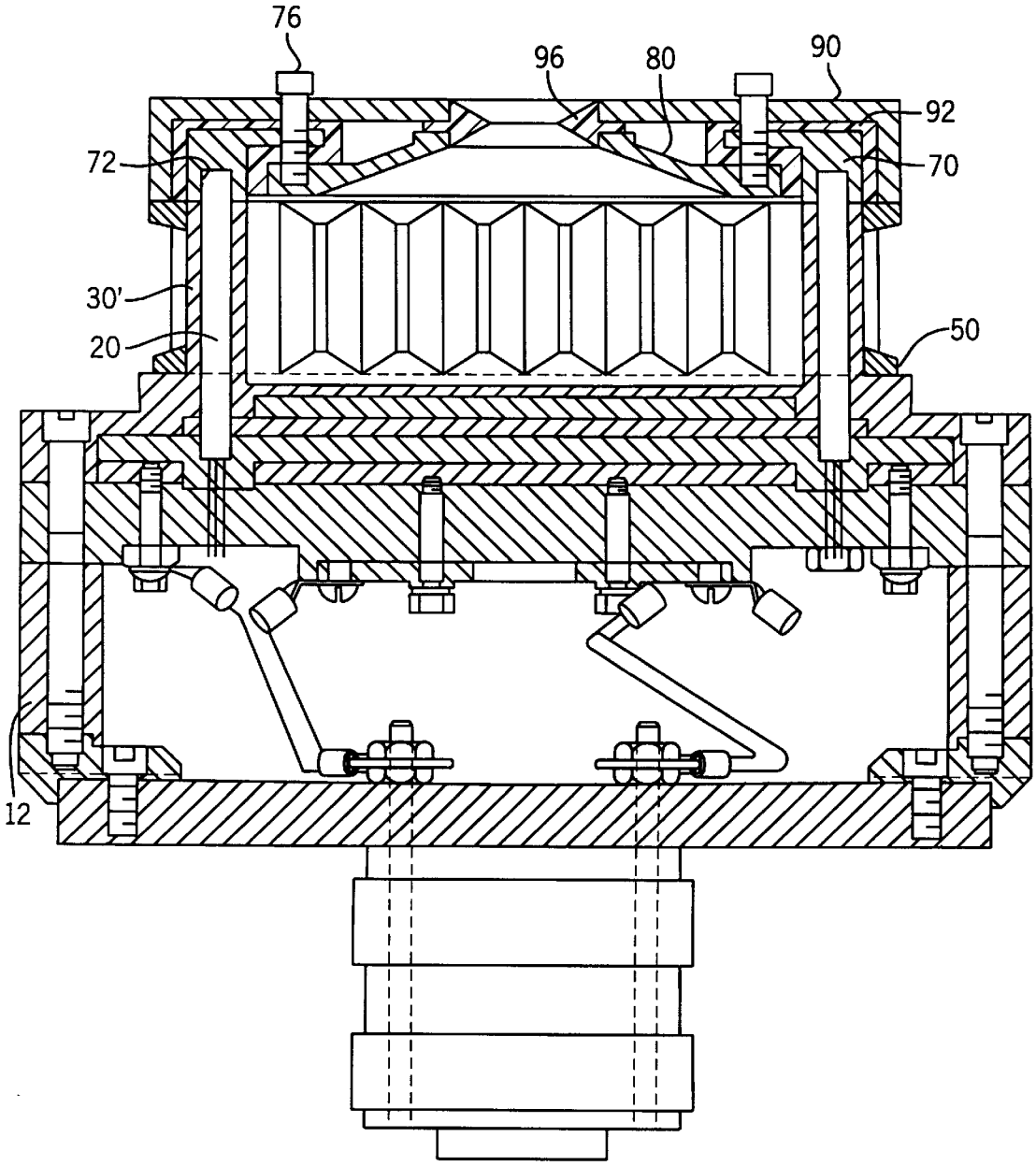
FIG. 8 is a cross-sectional view of the alternative embodiment of the spinner head shown in FIG. 7.

In an alternative embodiment shown in FIGS. 7 and 8, restriction ring 50 and cover of the spinner head may be attached without the use of tie bars by way of a swaging annulus 70 which is secured to an upper portion of heating elements 20. Annular housing 30' is similar to housing 30, however, the cylindrical passages extend completely through annular housing 30' permitting heating elements 20 to extend out beyond the top thereof. In this embodiment, swaging annulus 70 includes a groove 72 formed therein which is adapted to frictionally engage the upper portion of the heating elements 20. The swaging annulus 70 further includes a series of spaced through holes 74 which allow the passage of a fastening bolt 76 as shown in FIG. 8. The fastening bolt threadedly engages a beveled ring 80 which includes a series of spaced threaded apertures 82 to threadedly receive bolt 76. A stainless steel cover 90 is positioned over a first insulation ring 92 which thermally insulates cover 90 from the processing wall. Cover 90 and first insulation ring 92 are placed over swaging annulus 70. A second insulation ring 94 is positioned between swaging annulus 70 and beveled ring 80. A third insulation ring 96 is positioned between and held by the radially inner portions of beveled ring 80 and cover 90. Third insulating ring 96 has a tapered radially inner portion and provides a stick-free surface for the material to be poured in through the cover into the spinning head chamber 25. These various parts are held together by bolts 76 which extends through the various components. The top cover is then held on the spinner head through the mechanical attachment between the upper portions of the heating tubes and the swaging annulus. Thus, with this design the need for tie rods is eliminated, and therefore, the entire circumference of the annular housing is available for processing of material.

In the preferred embodiment the cap 90 and beveled ring 80 are preferably formed of stainless steel. The insulating rings 92, 94, and 96 are preferably formed of a polytetrafluoroethylene (PTFE) material such as Teflon.

In order to further prevent clogging and the formation of unwanted restrictions in the processing wall, the present invention also provides a device for preventing the material from being heating too quickly before expulsion from the spinner head. New formulations with non-melting ingredients have in the past caused clogging of the spinning head due to the separation of different components of the material to be processed. The cause of this separation has been found to be the pre-melting of some ingredients at the bottom center plate 100 of the annular housing which is elevated in temperature by heating elements 20 through conduction. In order to prevent this undesirable pre-melting of the feedstock, the present invention includes a heat isolation disk 102 installed in the bottom on the spinner head to substantially thermally isolated the feedstock material from the bottom plate 100. In this embodiment the heat isolation disk 102 can include a disk-like piece of PTFE material which can be mechanically fastened to the bottom plate 100, as shown in FIGS. 3 and 4, in any manner well known in the art.

Various changes to the foregoing described and shown structures would now be evident to those skilled in the art. Accordingly, the particularly disclosed scope of the invention is set forth in the following claims.

What is claimed is:

1. A spinner head comprising:

a base;

a cover aligned with and spaced from said base; and a plurality of discrete elongate heating elements defining elongate spaces therebetween said heating elements being positioned between said base and said cover and further defining a perimetrical configuration;

an elongate generally annular housing having plural circumferentially spaced cylindrical passages extending therethrough, said housing being positionable over said heating elements with said heating elements residing within said passages, said cover and said annular housing mutually defining a chamber for accommodating therein a foodstuffs or pharmaceutical feedstock material which undergoes physical transformation with the application of heat and force and instantly reforms as a solid having a changed morphology; and said housing defining a plurality of circumferentially spaced fins projecting radially inward, said plurality of fins defining a processing wall for acting upon the feedstock, each of said fins having tapered sidewalls which generally converge to substantially a point as said fin extends radially inward to form a non-planar inner surface which resists the formation of stagnation points, and said sidewalls of adjacent fins cooperating to define longitudinal radially-directed slots between said cylindrical passages so as to permit passage of the feedstock material therethrough.

2. The spinner head of claim 1 wherein each of said plurality of fins corresponds to one of said plurality of cylindrical passages.

3. The spinner head of claim 1 wherein said radially-directed slots narrow upon extending radially outwardly.

4. The spinner head of claim 1 wherein said sidewalls of each of said fins include a first portion and a second portion disposed radially inward of said first portion, and wherein said second portion is inclined more than said first portion.

5. The spinner head of claim 1 wherein said fins which are adjacently disposed are spaced a distance from each other and said distance varies over said radial extent of said adjacent fins.

6. The spinner head of claim 1 further including a flow restriction device disposed exteriorly about said annular housing for effecting the flow of feedstock material from said spinner head.

7. The spinner head of claim 6 wherein said flow restriction device includes an annular wall, said wall defining a plurality circumferentially spaced openings extending radially therethrough.

8. The spinner head of claim 7 wherein each of said openings of said flow restricting device has a radial inner and outer end and said radially inner end of each opening substantially radially aligns with one of said plurality of slots to permit restricted passage of said expelled feedstock material therethrough.

9. The spinner head of claim 8 wherein at least one of said openings of said restriction device extends at an angle from said corresponding slot such that said radially inner and outer ends are circumferentially offset.

10. The spinner head of claim 9 wherein the angle of said at least one of said openings of said restriction device is less than an angle of repose of said feedstock material processed within said spinner head in order to prevent formation of stagnation points.

11. The spinner head of claim 10 wherein said annular housing and said restriction device are formed of a heat conducting material such that the feedstock material is heated upon passage through said slots of said annular housing and said openings of said restriction device.

12. The spinner head of claim 1 wherein said annular housing includes an upper portion and a lower portion and a flange extending from said lower portion, said flange including a plurality of apertures therein to permit fastening hardware to extend therethrough to secure said housing to said base.

13. The spinner head of claim 12 said annular housing upper portion including a plurality of apertures formed therein and retaining mounting hardware for securing said cover to said annular housing.

14. The spinner head of claim 1 wherein an upper portion of each of said plurality of heating elements extends beyond said annular housing and said cover includes a securement annulus that is mechanically secured to an upper portion of said plurality of heating elements.

15. The spinner head of claim 14 wherein said cover includes an aperture therein to permit the feedstock material to enter said chamber, and said cover is securable to said securement annulus.

16. A processing wall for use with a spinner head having tubular heating elements comprising:

an elongate generally annular housing having plural circumferentially spaced cylindrical passages extending therethrough, said housing being positionable over the heating elements with said heating elements residing within said passages, said housing defining a plurality of circumferentially spaced fins projecting radially inward to form a non-planar surface which resists the formation of stagnation points, each of said fins having a pair of tapered sidewalls which generally converge to substantially a point as said fin extends radially inward forming a generally non-planar surface, and one of said pair of sidewalls of adjacent fins cooperating to define a plurality of longitudinal radially-directed slots between said cylindrical passages so as to instantly reform foodstuffs or pharmaceutical feedstock material which passes therethrough into a solid having a changed morphology.

17. The processing wall of claim 16 further including a flow restriction device disposed exteriorly about said annular housing for effecting the flow of feedstock material from said spinner head.

18. The spinner head of claim 17 wherein said flow restriction device includes an annular wall, said wall defining a plurality circumferentially spaced openings extending radially therethrough, and wherein each of said openings has a radial inner and outer end and said radially inner end of each opening substantially radially aligns with one of said plurality of slots to permit restricted passage of said expelled feedstock material therethrough.

19. The spinner head of claim 18 wherein at least one of said openings of said restriction device extends at an angle from said corresponding slot such that said radially inner and outer ends are circumferentially offset.

20. A spinner head comprising:

a base;

a cover aligned with and spaced from said based; and a plurality of discrete elongate heating elements defining elongate spaces therebetween said heating elements being positioned between said based and said cover and further defining a perimetrical configuration;

an elongate generally annular housing having plural circumferentially spaced cylindrical passages extending therethrough, said housing being positionable over said heating elements with said heating elements residing within said passages, said housing defining a plurality of circumferentially spaced radially directed slots, so as to permit passage of said feedstock material therethrough, and wherein an upper portion of each of said plurality of heating elements extends beyond said annular housing;

said cover and said annular housing mutually defining a chamber for accommodating therein a foodstuffs or pharmaceutical feedstock material which undergoes physical transformation with the application of heat and force and instantly reforms as a solid having a changed morphology after exiting said chamber; and a securement annulus that is mechanically secured to an upper portion of said plurality of heating elements, said annulus providing means for securing said cover onto said spinner head.

21. The spinner head of claim 5 wherein said fins do not present a planar or tangential surface upon which said feedstock may build up and form stagnation points.

22. The processing wall of claim 16 wherein said fins do not present a planar or tangential surface upon which said feedstock may build up and form stagnation points.

23. The spinner head of claim 20 wherein said housing further defines a plurality of circumferentially spaced fins projecting radially inward, said plurality of fins defining a processing wall for acting upon the feedstock material, each of said fins having tapered sidewalls which generally converge to substantially a point as said fin extends radially inward to form a non-planar inner surface which resists the formation of stagnation points, and said sidewalls of adjacent fins cooperating to define said circumferentially spaced radially-directed slots.

24. The spinner head of claim 23 wherein said fins do not present a planar or tangential surface upon which said feedstock may build up and form stagnation points.

* * * * *